US007730843B1

(12) United States Patent
Sovel

(10) Patent No.: US 7,730,843 B1
(45) Date of Patent: Jun. 8, 2010

(54) HULL-MOUNTED LINE RETRIEVAL AND RELEASE SYSTEM

(75) Inventor: James E. Sovel, Panama City Beach, FL (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 344 days.

(21) Appl. No.: 11/973,984

(22) Filed: Sep. 25, 2007

(51) Int. Cl.
*B63B 17/00* (2006.01)
*B63B 21/00* (2006.01)
*B63B 21/04* (2006.01)

(52) U.S. Cl. ..... 114/218

(58) Field of Classification Search ..... 114/213–218, 114/221 R, 230.2–230.3, 249–254, 380, 381; 24/132 R–132 WL, 599.4–599.8; 294/82.19, 294/82.2, 82.27, 82.33
See application file for complete search history.

(56) References Cited

U.S. PATENT DOCUMENTS 447,421 A * 3/1891 Wogan ..... 114/380
3,174,790 A * 3/1965 Bendl ..... 294/82.3
4,281,867 A * 8/1981 Kariagin ..... 294/82.33

* cited by examiner

*Primary Examiner*—Ajay Vasudeva
(74) *Attorney, Agent, or Firm*—James T. Shepherd

(57) ABSTRACT

A line retrieve-release system is provided for mounting on the hull of a boat. First and second jaw mechanisms coupled to the hull face substantially forward and aft, respectively, relative to the boat's bow. Each jaw mechanism is capable of movement between a partially open position and a fully open position. First and second latches are coupled to the first and second jaw mechanisms, respectively. Each latch is biased to cooperate with its respective jaw mechanism in the partially open position thereof to thereby define a corresponding enclosed region. Each latch permits one-way entry to its associated enclosed region when a force is applied thereto from outside of the enclosed region. Each jaw mechanisms' partially open position defines a "ready-to-retrieve" and "line capture" position of the system, while each jaw mechanisms' fully open position defines a "line release" position of the system. Additional mechanism(s) are provide to (i) move each of the jaw mechanisms to their respective fully open position to thereby open the associated enclosed regions to facilitate the release of a captured line, and (ii) reset the retrieve-release system to its "ready-to-retrieve" and "line capture" position.

9 Claims, 2 Drawing Sheets

HULL-MOUNTED LINE RETRIEVAL AND RELEASE SYSTEM

ORIGIN OF THE INVENTION

The invention described herein was made in the performance of official duties by an employee of the Department of the Navy and may be manufactured, used, licensed by or for the Government for any governmental purpose without payment of any royalties thereon.

FIELD OF THE INVENTION

The invention relates generally to the retrieval and releasing of floating lines from a floating vessel, and more particularly to a hull-mounted line retrieval and release system that can retrieve and capture a line floating at or near the water's surface and also release the line so-captured.

BACKGROUND OF THE INVENTION

A ship or other surface-floating vessel frequently must be able to deploy and/or retrieve a "line" (e.g., tow rope or cable, towed sensor array, mooring line, etc.) floating at or near the water's surface. For example, an autonomous ship/vessel is frequently deployed from a mother ship and recovered by a mother ship using a mechanism (mounted on the autonomous ship/vessel) that can automatically retrieve and release a line that is towed behind a mother ship. Given the prevalence of autonomous ships/vessels in the Navy, there is a need for a mechanism that can accomplish these tasks quickly and reliably.

SUMMARY OF THE INVENTION

Accordingly, it is an object of the present invention to provide a ship/vessel mounted system that can retrieve a line floating at or near the water's surface.

Another object of the present invention is to provide a ship/vessel mounted system that can retrieve and capture a line floating at or near the water's surface and also release the line so-captured.

Other objects and advantages of the present invention will become more obvious hereinafter in the specification and drawings.

In accordance with the present invention, a line retrieve-release system is provided for mounting on the hull of a boat. A first jaw mechanism is coupled to the hull and faces substantially forward relative to the boat's bow. The first jaw mechanism is capable of movement between a partially open position and a fully open position. A first latch is coupled to the first jaw mechanism and is biased to cooperate therewith in the partially open position thereof to thereby defined a first enclosed region bounded by the first jaw mechanism and the first latch. The first latch permits one-way entry to the first enclosed region when a force is applied to the first latch from outside of the first enclosed region. A second jaw mechanism is also coupled to the hull and faces substantially aft relative to the boat's bow. The second jaw mechanism is capable of movement between a partially open position and a fully open position. A second latch is coupled to the second jaw mechanism and is biased to cooperate therewith in the partially open position thereof to thereby define a second enclosed region bounded by the second jaw mechanism and the second latch. The second latch permits one-way entry to the second enclosed region when a force is applied to the second latch from outside of the second enclosed region. Each jaw mechanisms' partially open position defines a "ready-to-retrieve" and "line capture" position of the system, while each jaw mechanisms' fully open position defines a "line release" position of the system. Additional mechanism(s) are provided to move each of the first and second jaw mechanisms to their respective fully open position to thereby open the first and second enclosed regions.

BRIEF DESCRIPTION OF THE DRAWINGS

Other objects, features and advantages of the present invention will become apparent upon reference to the following description of the preferred embodiments and to the drawings, wherein corresponding reference characters indicate corresponding parts throughout the several views of the drawings and wherein.

DETAILED DESCRIPTION OF THE INVENTION

Figure 1:
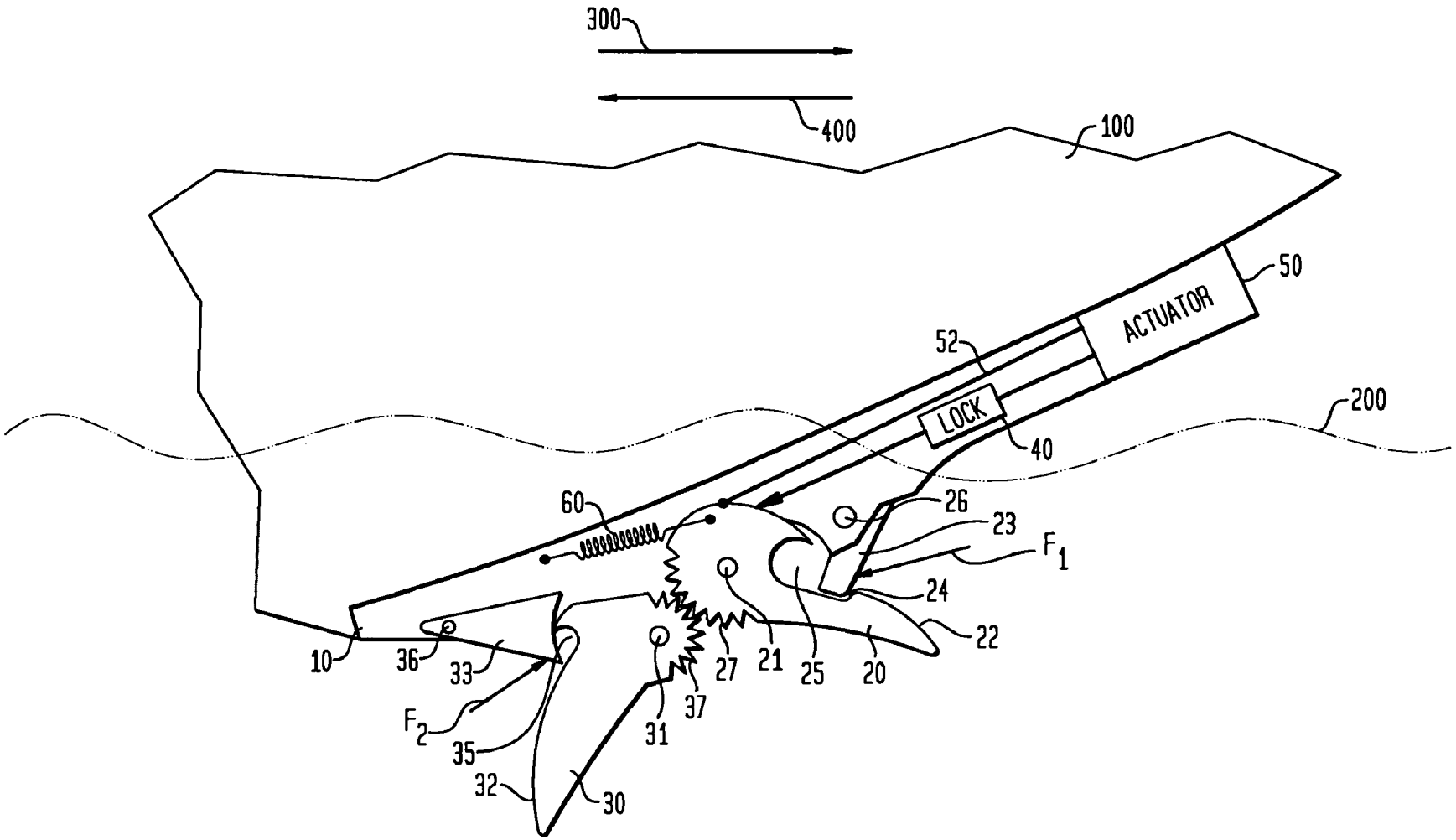
FIG. 1 is a part perspective view and part schematic view of a line retrieve-release system attached to a boat hull where the system is illustrated in its ready-to-retrieve and line-captured position in accordance with an embodiment of the present invention.

Referring now to the drawings and more particularly to FIG. 1, a portion of surface-floating vessel hull is referenced by numeral 100. By way of illustration the portion of hull 100 is the vessel's bow that sits just above and below the water's surface designated by the dashed line referenced by numeral 200. While the illustrated embodiment of the inventive line retrieve/release system is mounted on the bow portion of hull 100 that is just below surface 200, it is to be understood that this system could be mounted on other portions of a vessel's hull without departing from the scope of the present invention.

The present line retrieve/release system has a support frame or housing 10 that is mounted to hull 100. Housing 10 provides the support and mounting framework for the components of the line retrieve/release system used to retrieve a line (not shown) floating at or near surface 200 when hull 100 is moving in a forward direction (indicated by arrow 300) or a backward direction (indicated by arrow 400). The terms "forward" and "backward" as used herein are relative to the vessel's illustrated bow portion of hull 100. A forward guide arm 20 and an aft guide arm 30 are mounted to housing 10. More specifically, forward guide arm 20 is pivotally coupled to housing 10 using, for example, a pin 21 that allows rotation of guide arm 20 in a two-dimensional plane of rotation so that the combination of housing 10 and front guide arm 20 define jaws. Guide arm 20 points substantially forward of hull 100, i.e., towards forward direction 300. The outboard portion of guide arm 20 can be shaped to define a convex curve at the portion thereof facing the water's surface 200 as indicated by reference numeral 22. As will be explained further below, convexly-shaped portion 22 defines a smooth shape that improves the line retrieve and release action of the present invention as a line slides thereover.

Also coupled to housing 10 is a forward spring latch 23 that is spring-biased to cooperate with a notch 24 in guide arm 20 such that an enclosed line capture region 25 is defined by guide arm 20 and latch 23. In the illustrated embodiment, guide arm 20 is C-shaped where defining its portion of capture region 25 to facilitate line release action as will be explained further below. Note that depending on the shape of guide arm 20 and latch 23, housing 10 could also define a portion of capture region 25. In the illustrated embodiment, spring latch 23 is pivotally mounted to housing 10 using, for example, a pin 26 with spring latch 23 being spring-biased into notch 24 as shown. Latch 23 cooperates with notch 24 to maintain the integrity of capture region 25 when a line (not shown) is captured in capture region 25.

Aft guide arm 30 is pivotally coupled to housing 10 using, for example, a pin 31 that allows rotation of guide arm 30 in the same two-dimensional plane of rotation as guide arm 20 so that the combination of housing 10 and aft guide arm 30 define jaws. Guide arm 30 points substantially towards the rear of hull 100, i.e., towards backward direction 400. The outboard portion of guide arm 30 can be shaped to define a convex curve at the portion thereof facing the water's surface 200 as indicated by reference numeral 32. Similar to convexly-shaped portion 22, convexly-shaped portion 32 defines a smooth shape that improves the line retrieve and release action of the present invention as a line slides thereover.

Also coupled to housing 10 is an aft spring latch 33 that is spring-biased to cooperate with guide arm 30 such that an enclosed line capture region 35 is defined by guide arm 30 and latch 33. In the illustrated embodiment, guide arm 30 is C-shaped where defining its portion of capture region 35 to facilitate line release action as will be explained further below. Note that depending on the shape of guide arm 30 at capture region 35, housing 10 could also define a portion of capture region 35. In the illustrated embodiment, spring latch 33 is pivotally mounted to housing 10 using, for example, a pin 36 with spring latch 33 being spring-biased to contact guide arm 30 as shown.

Each of guide arms 20 and 30 is provided with an arcuate arrangement of gear teeth 27 and 37 that mesh with one another such that rotational movement of one of guide arms 20 or 30 causes rotational movement of the other guide arm. In the illustrated embodiment, clockwise rotation of guide arm 20 about pin 21 results in corresponding counter-clockwise rotation of guide arm 30 about pin 31. As will be explained further below, such rotational movement of guide arms 20 and 30 effects the line release action of the present invention.

FIG. 1 illustrates the present invention in its "ready-to-retrieve" and "line capture" position. That is, in this illustrated position, the present invention is poised to retrieve and capture a line when hull 100 is moving in either forward direction 300 or backward direction 400. To maintain the present invention in this position, rotational movement of guide arms 20 and 30 must be inhibited. By way of example, such rotational movement inhibition can be achieved with a spring-loaded lock mechanism 40 cooperating with guide arm 20 as shown. However, it is to be understood that such rotational movement inhibition could be accomplished in a variety of ways without departing from the scope of the present invention.

With the present invention in the position illustrated in FIG. 1, a line (not shown) can be retrieved/captured when hull is moving in either direction 300 or 400. Specifically, when hull is moving in forward direction 300, a line floating at/near water surface 200 and crossing the path of such forward movement is eventually engaged by guide arm 20 and/or the face of latch 23. Convexly-shaped portion 22 facilitates the guidance of a line towards latch 23. As hull 100 continues in direction 300, the line will cause a force $F_1$ to be applied to latch 23. When force $F_1$ overcomes the spring bias of latch 23, the line is admitted into capture region 25 and the spring bias of latch 23 biases the latch back into notch 24. In similar fashion, when hull 100 is moving in backward direction 400, a line floating at/near water surface 200 and crossing the path of such backward movement is eventually engaged by guide arm 30 and/or the face of latch 33. Convexly-shaped portion 32 facilitates the guidance of a line towards latch 33. As hull 100 continues in direction 400, the line causes a force $F_2$ to be applied to the face of latch 33 as shown. Once force $F_2$ overcomes the spring bias of latch 33, the line is admitted into capture region 35 and latch 33 is biased back into contact with guide arm 30.

Figure 2:
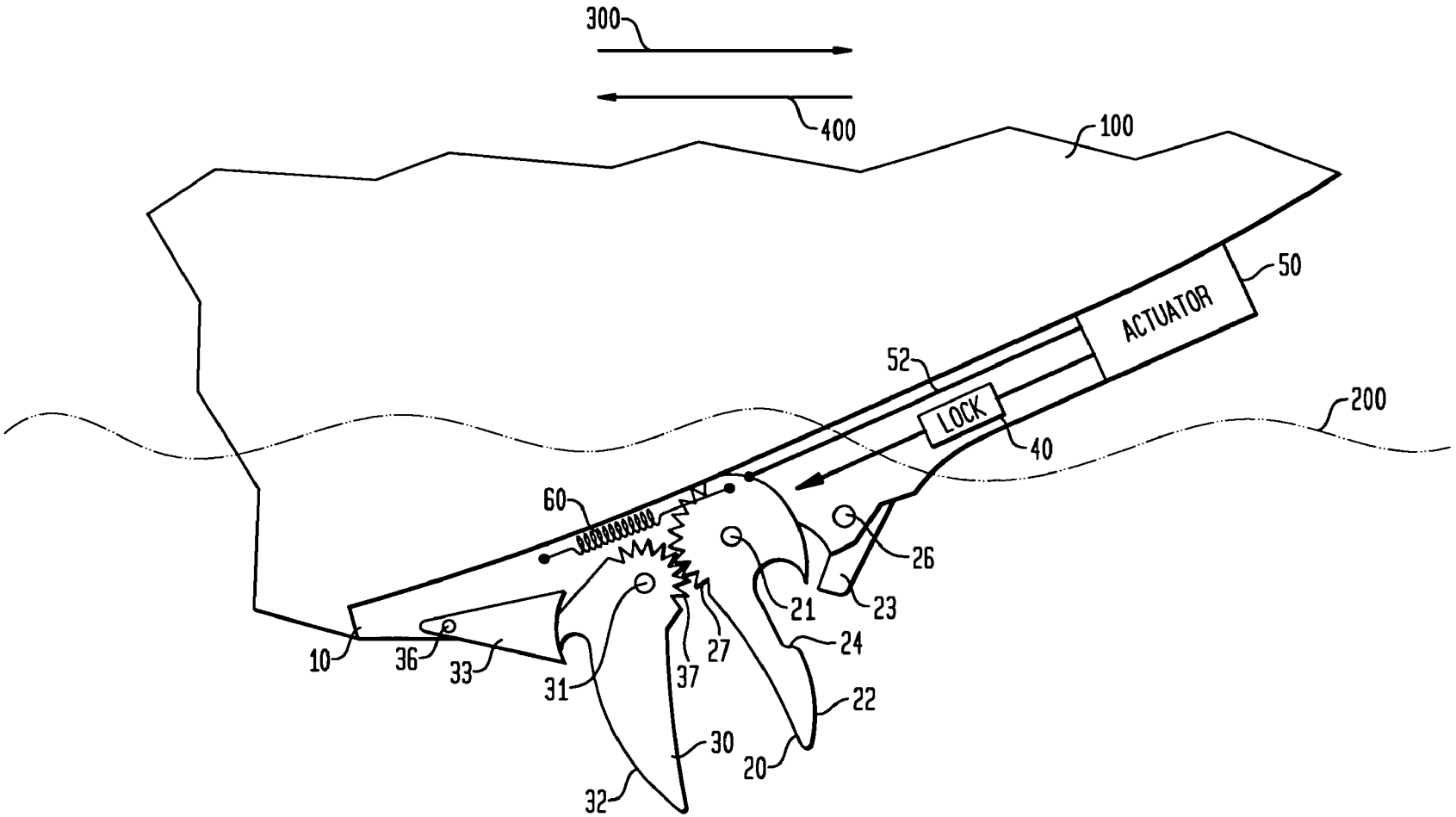
FIG. 2 is a part perspective view and part schematic view of the line retrieve-release system illustrated in its line released position.

To release a line retrieved and captured as just described, a simple release mechanism is provided to release a line captured in either of capture regions 25 or 35. An actuator 50 is coupled to lock mechanism 40 and to guide arm 20 via a rod or cable 52. Lock mechanism 40 is representative of any mechanism that can engage guide arm 20 to prevent rotation thereof and be disengaged from guide arm 20 to allow rotation thereof. Referring additionally now to FIG. 2, the release of a captured line will be explained. Hull 100 can be stationary or moving during line release. If hull 100 is moving, movement should be opposite of that used during line retrieval in order to enhance the release process. That is, to release a line in capture region 25, hull 100 should move in backward direction 400 whereas hull 100 should move in forward direction 300 to release a line in capture region 35. In either case, to begin the line release process, actuator 50 acts on lock mechanism 40 so that rotational movement of guide arms 20 and 30 is no longer inhibited. Next, actuator 50 tensions cable 52 to thereby generate clockwise rotation of guide arm 20 which, in turn, generates corresponding counter-clockwise rotation of guide arm 30 until capture regions 25 and 35, respectively, no longer exist as shown in FIG. 2. In the illustrated embodiment, the C-shaped regions of guide arms 20 and 30 that define a portion of respective capture regions 25 and 35 also serve to push a line therefrom when guide arms 20 and 30 are rotated by actuator 50/cable 52.

Once a line has been released, the present invention is returned to its "ready-to-retrieve" position (FIG. 1). This can be achieved by reversing the tension in rod-cable 52 so that guide arm 20 is rotated in a counter-clockwise fashion to thereby rotate guide arm 30 in a clockwise fashion. This process can also be aided or alternatively achieved by means of a spring 60 coupled to housing 10 and guide arm 20. More specifically, line release movement of guide arm 20 would place spring 60 in tension where such spring tension would then be used to return guide arms 20/30 back to their "ready-to-retrieve" position. Once back in this position, lock mechanism 40 would again engage guide arm 20.

The advantages of the present invention are numerous. A floating line can be retrieved/released by a simple mechanism mounted on a vessel's hull. Line retrieval/release can be accomplished when the vessel moves either forward or backward using a single mechanism. Having two ways of catching a line increases the likelihood that the line is caught on the first try.

Although the invention has been described relative to a specific embodiment thereof, there are numerous variations and modifications that will be readily apparent to those skilled in the art in light of the above teachings. It is therefore to be understood that, within the scope of the appended claims, the invention may be practiced other than as specifically described.

What is claimed as new and desired to be secured by Letters Patent of the United States is:

1. A line retrieve-release system mounted on a hull of a boat, comprising:

first jaw means coupled to the hull of the boat and facing substantially forward relative to the bow of the boat, said first jaw means being capable of movement between a partially open position and a fully open position;

a first latch coupled to said first jaw means and biased to cooperate therewith in said partially open position thereof to thereby define a first enclosed region bounded by said first jaw means and said first latch, said first latch coupled to said first jaw means to permit one-way entry to said first enclosed region when a force is applied to said first latch from outside of said first enclosed region;

second jaw means coupled to the hull of the boat and facing substantially aft relative to the bow of the boat, said second jaw means being capable of movement between a partially open position and a fully open position;

a second latch coupled to said second jaw means and biased to cooperate therewith in said partially open position thereof to thereby define a second enclosed region bounded by said second jaw means and said second latch, said second latch coupled to said second jaw means to permit one-way entry to said second enclosed region when a force is applied to said second latch from outside of said second enclosed region; and means coupled to said first jaw means and said second jaw means for cooperatively moving each of said first jaw means and said second jaw means to their respective said fully open position to thereby open said first enclosed region and said second enclosed region, wherein said first jaw means is in toothed engagement with said second jaw means such that said movement to each respective said fully open position occurs in correspondence.

2. A line retrieve-release system as in claim 1 wherein said means includes a locking mechanism for locking each of said first jaw means and said second jaw means in their respective said partially open position.

3. A line retrieve-release system as in claim 1 wherein said means includes a return mechanism for returning each of said first jaw means and said second jaw means to their respective said partially open position from their respective said fully open position.

4. A line retrieve-release system mounted on a hull of a boat, comprising:

first jaw means coupled to the hull of the boat and facing substantially forward relative to the bow of the boat, said first jaw means being capable of movement between a partially open position and a fully open position;

a first latch coupled to said first jaw means and biased to cooperate therewith in said partially open position thereof to thereby define a first enclosed region bounded by said first jaw means and said first latch, said first latch coupled to said first jaw means to permit one-way entry to said first enclosed region when a force is applied to said first latch from outside of said first enclosed region;

second jaw means coupled to the hull of the boat and facing substantially aft relative to the bow of the boat, said second jaw means being capable of movement between a partially open position and a fully open position;

a second latch coupled to said second jaw means and biased to cooperate therewith in said partially open position thereof to thereby define a second enclosed region bounded by said second jaw means and said second latch, said second latch coupled to said second jaw means to permit one-way entry to said second enclosed region when a force is applied to said second latch from outside of said second enclosed region; and means coupled to said first jaw means and said second jaw means for (i) locking each of said first jaw means and said second jaw means in their respective said partially open position, (ii) cooperatively moving each of said first jaw means and said second jaw means to their respective fully open position to thereby open said first enclosed region and said second enclosed region, and (iii) returning each of said first jaw means and said second jaw means to their respective said partially open position from their respective said fully open position, wherein said first jaw means is in toothed engagement with said second jaw means such that said movement to each respective said fully open position occurs in correspondence.

5. A line retrieve-release system mounted on a hull of a boat, comprising:

a housing coupled to the hull of the boat;

a first arm pivotally coupled to said housing and capable of clockwise rotational movement between (i) a first position in which said first arm points substantially forward relative to the bow of the boat, and (ii) a second position in which said first arm is angularly displaced from said first position thereof;

a first latch coupled to said housing and biased to cooperate with said first arm in said first position thereof to thereby define a first enclosed region bounded by at least said first arm and said first latch, said first latch coupled to said housing to permit one-way entry to said first enclosed region when a force is applied to said first latch from outside of said first enclosed region;

a second arm pivotally coupled to said housing and capable of counter-clockwise rotational movement between (i) a first position in which said second arm points substantially aft relative to the bow of the boat, and (ii) a second position in which said second arm is angularly displaced from said first position thereof;

a separate latch coupled to said housing and biased to cooperate with said second arm in said first position thereof to thereby define a second enclosed region bounded by at least said second arm and said second latch, said second latch coupled to said housing to permit one-way entry to said second enclosed region when a force is applied to said second latch from outside of said second enclosed region;

said first arm being coupled to said second arm such that said clockwise rotational movement and said counter-clockwise rotational movement occur in correspondence; and means coupled to one of said first arm and said second arm for generating said clockwise rotational movement and said counter-clockwise rotational movement to thereby open said first enclosed region and said second enclosed region.

6. A line retrieve-release system as in claim 5 wherein said means includes a locking mechanism for locking each of said first arm and said second arm in their respective said first position.

7. A line retrieve-release system as in claim 5 wherein said means includes a return mechanism for returning each of said first arm and said second arm to their respective said first position from their respective said second position.

8. A line retrieve-release system as in claim 5 wherein said first arm is in toothed engagement with said second arm.

9. A line retrieve-release system as in claim 5 wherein each of said first arm and said second arm is convexly shaped relative to the bow of the boat.

* * * * *